US011264760B2

(12) United States Patent
Fukatsu et al.

(10) Patent No.: US 11,264,760 B2
(45) Date of Patent: Mar. 1, 2022

(54) CONNECTOR

(71) Applicant: SUMITOMO WIRING SYSTEMS, LTD., Mie (JP)

(72) Inventors: Yukihiro Fukatsu, Mie (JP); Asuka Hanji, Mie (JP); Kazuo Nakai, Mie (JP); Masahiro Nakashima, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/017,021

(22) Filed: Sep. 10, 2020

(65) Prior Publication Data

US 2021/0098937 A1 Apr. 1, 2021

(30) Foreign Application Priority Data

Sep. 26, 2019 (JP) ..... JP2019-174916

(51) Int. Cl.

| | |
|---|---|
| ***H01R 13/62*** | (2006.01) |
| ***H01R 13/629*** | (2006.01) |
| ***H01R 13/627*** | (2006.01) |
| ***H01R 13/74*** | (2006.01) |

(52) U.S. Cl.

CPC ... *H01R 13/62927* (2013.01); *H01R 13/6271* (2013.01); *H01R 13/62911* (2013.01); *H01R 13/62922* (2013.01); *H01R 13/743* (2013.01)

(58) Field of Classification Search

CPC ..... H01H 2223/012

See application file for complete search history.

(56) References Cited

U.S. PATENT DOCUMENTS 9,806,453 B2 * 10/2017 Matsuura ..... H01R 13/50

FOREIGN PATENT DOCUMENTS

| | | |
|---|---|---|
| JP | H07-201418 A | 8/1995 |
| JP | 2008-071524 A | 3/2008 |
| JP | 2015-069837 A | 4/2015 |

* cited by examiner

*Primary Examiner* — Ross N Gushi

(74) *Attorney, Agent, or Firm* — Abelman, Frayne & Schwab

(57) ABSTRACT

A first housing 10 includes a resiliently deformable lock arm 30. The lock arm 30 has a lock surface 34 to be arranged to contact a front surface of a panel 90 with the first housing 10 arranged in a mounting hole 91 of the panel 90. A second housing 40 includes a space portion 53 into which an arm plate 72 of a lever 70 is arranged, leg portions 57 rising from the side of an outer wall 52 of the space portion 53 while facing each other, and a bridge portion 58 extending between the leg portions 57 facing each other. The bridge portion 58 includes a releasing portion 65 capable of releasing a state where the lock surface 34 is in contact with the front surface of the panel 90.

7 Claims, 14 Drawing Sheets

CONNECTOR

CROSS-REFERENCE TO RELATED APPLICATIONS

This application is based on and claims priority from Japanese Patent Application No. 2019-174916, filed on Sep. 26, 2019, with the Japan Patent Office, the disclosure of which is incorporated herein in their entireties by reference.

TECHNICAL FIELD

The present disclosure relates to a connector.

BACKGROUND

A connector described in Japanese Patent Laid-open Publication No. 2015-069837 (FIG. 14) includes a standby-side housing to be mounted in a standby state on a panel and a fitting-side housing to be fit to the standby-side housing. The standby-side housing is inserted into a mounting hole of the panel. The standby-side housing includes a flange capable of contacting the rear surface (back surface) of the panel. Further, the standby-side housing includes a temporary holding piece. The temporary holding piece includes a locking portion capable of contacting the front surface (surface) of the panel. The standby-side housing is mounted on the panel while sandwiching the panel between the locking portion and the flange.

The fitting-side housing includes an insertion path into which a slide plate of a slide lever is inserted. The fitting-side housing includes a temporary holding releasing plate on an end part forward of an outer wall of the insertion path. The temporary holding releasing plate rides on the temporary holding piece to deflect and deform the temporary holding piece inwardly (toward the mounting hole). When the fitting-side housing is properly fit to the standby-side housing, the entire temporary holding piece is deflected and deformed toward the mounting hole to release the locking of the standby-side housing and the panel. Connectors of this panel mounted type are also disclosed in Japanese Patent Laid-open Publication Nos. 2008-071524 and H07-201418.

SUMMARY

A request for connector miniaturization can be met by making a front-rear length (length in a connecting direction) of the connector shorter. For example, if the outer wall of the insertion path and a receptacle of the standby-side housing are in a positional relationship to overlap each other in a front-rear direction, the front-rear length of the connector can be made shorter. If the outer wall and the receptacle are in the positional relationship to overlap each other in the front-rear direction, the temporary holding releasing plate is provided on the outer wall of the insertion path. However, since the outer wall of the insertion path may be deflected and deformed, there is a problem of being difficult to ensure the strength of the temporary holding releasing plate.

Accordingly, it is aimed to provide a connector capable of ensuring the strength of a releasing portion for releasing a state mounted on a panel.

The present disclosure is directed to a connector with a first housing, a second housing connectable to the first housing, and a lever arranged on the second housing, the lever being capable of promoting connection of the first housing and the second housing, wherein the first housing includes a resiliently deformable lock arm, the lock arm has a lock surface to be arranged to contact a front surface of a panel with the first housing arranged in a mounting hole of the panel, the second housing includes a space portion into which an arm plate of the lever is arranged, leg portions rising from the side of an outer wall of the space portion while facing each other, and a bridge portion extending between the leg portions facing each other, and the bridge portion includes a releasing portion capable of releasing a state where the lock surface is in contact with the front surface of the panel.

According to the present disclosure, it is possible to provide a connector capable of ensuring the strength of a releasing portion for releasing a state mounted on a panel.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
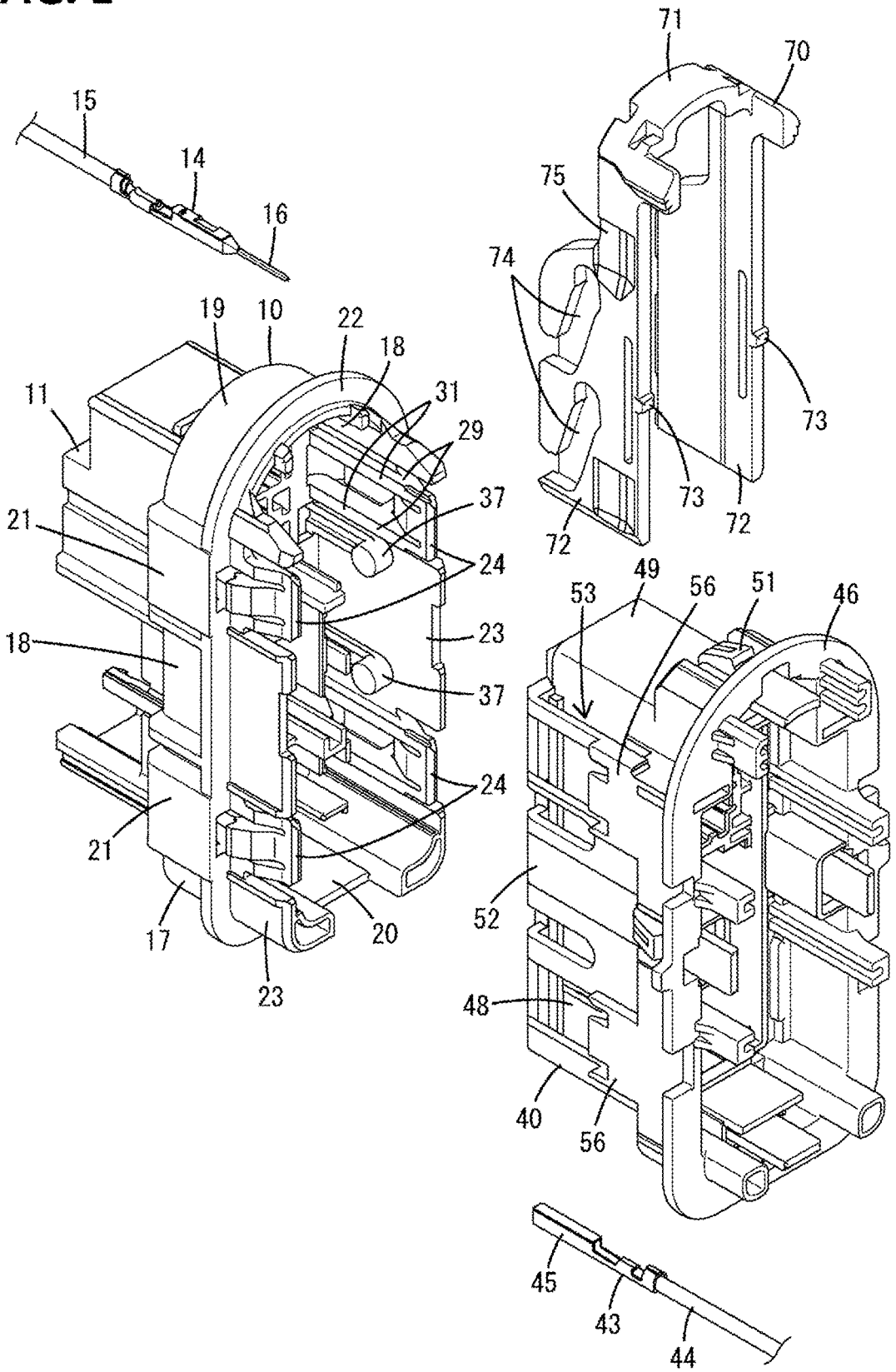
FIG. 1 is an exploded perspective view of a connector according to an embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure is proved with a first housing, a second housing connectable to the first housing, and a lever arranged on the second housing, the lever being capable of promoting connection of the first housing and the second housing, wherein the first housing includes a resiliently deformable lock arm, the lock arm has a lock surface to be arranged to contact a front surface of a panel with the first housing arranged in a mounting hole of the panel, the second housing includes a space portion into which an arm plate of the lever is arranged, leg portions rising from the side of an outer wall of the space portion while facing each other, and a bridge portion extending between the leg portions facing each other, and the bridge portion includes a releasing portion capable of releasing a state where the lock surface is in contact with the front surface of the panel. According to this configuration, an arch structure is formed by the leg portions facing each other and the bridge portion. The releasing portion is provided on the bridge portion, which is a part of the arch structure. By providing the arch structure on the outer wall of the space portion, the rigidity of the outer wall of the space portion can be enhanced and, eventually, the rigidity of the releasing portion can be enhanced. As a result, the releasing portion can maintain durability against a reaction force of the lock arm. Further, the space portion and the first housing can be in a positional relationship to overlap each other in a front-rear direction, which can contribute to the miniaturization of the connector.

(2) Preferably, the first housing includes a base portion, a coupling portion located forward of the base portion, and a linking portion linking between the base portion and the coupling portion, and the lock arm is shaped to project rearward toward the base portion from the coupling portion. According to this configuration, the lock arm is shaped to project in a connecting direction of the second housing. Thus, the lock arm can be prevented from facing and butting against the releasing portion in the process of fitting the second housing. As a result, the lock arm can be smoothly resiliently deformed.

(3) The first housing may include protecting portions on both sides of the linking portion via slits, and the leg portions may be arranged in the slits with the first and second housing connected. According to this configuration, movements of the linking portion can be restricted by the leg portions. As a result, the lock arm can be stably resiliently deformed.

Details of Embodiment of Present Disclosure

A specific example of the connector of the present disclosure is described below with reference to the drawings. Note that the present invention is not limited to these illustrations and is intended to be represented by claims and include all changes in the scope of claims and in the meaning and scope of equivalents.

A connector is composed of a first connector (standby-side connector) and a second connector (fitting-side connector). As shown in FIG. 1, the first connector includes a first housing 10. The second connector includes a second housing 40 and a lever 70.

The first housing 10 is inserted into a mounting hole 91 provided in a panel 90 and primarily (in a temporarily held state) on the panel 90. The second housing 40 is lightly fit to the first housing 10 mounted on the panel 90. In that state, the second housing 40 is connected to a proper depth to the first housing 10 according to a displacement of the lever 70. When the both housings 10, 40 are properly connected, the locking of the first housing 10 on the panel 90 is released. Thereafter, the second housing 40 is properly mounted on the panel 90.

Note that, in the following description, surface sides facing each other when the connection of the both housings 10, 40 is started are referred to as front sides concerning a front-rear direction. A vertical direction is based on figures except FIGS. 5, 9, 11 and 13. The panel 90 is, for example, a door panel of an unillustrated automotive vehicle, a rear surface side is equivalent to a vehicle interior side and a front surface side is equivalent to a vehicle exterior side.

(First Housing 10)

Figure 2:
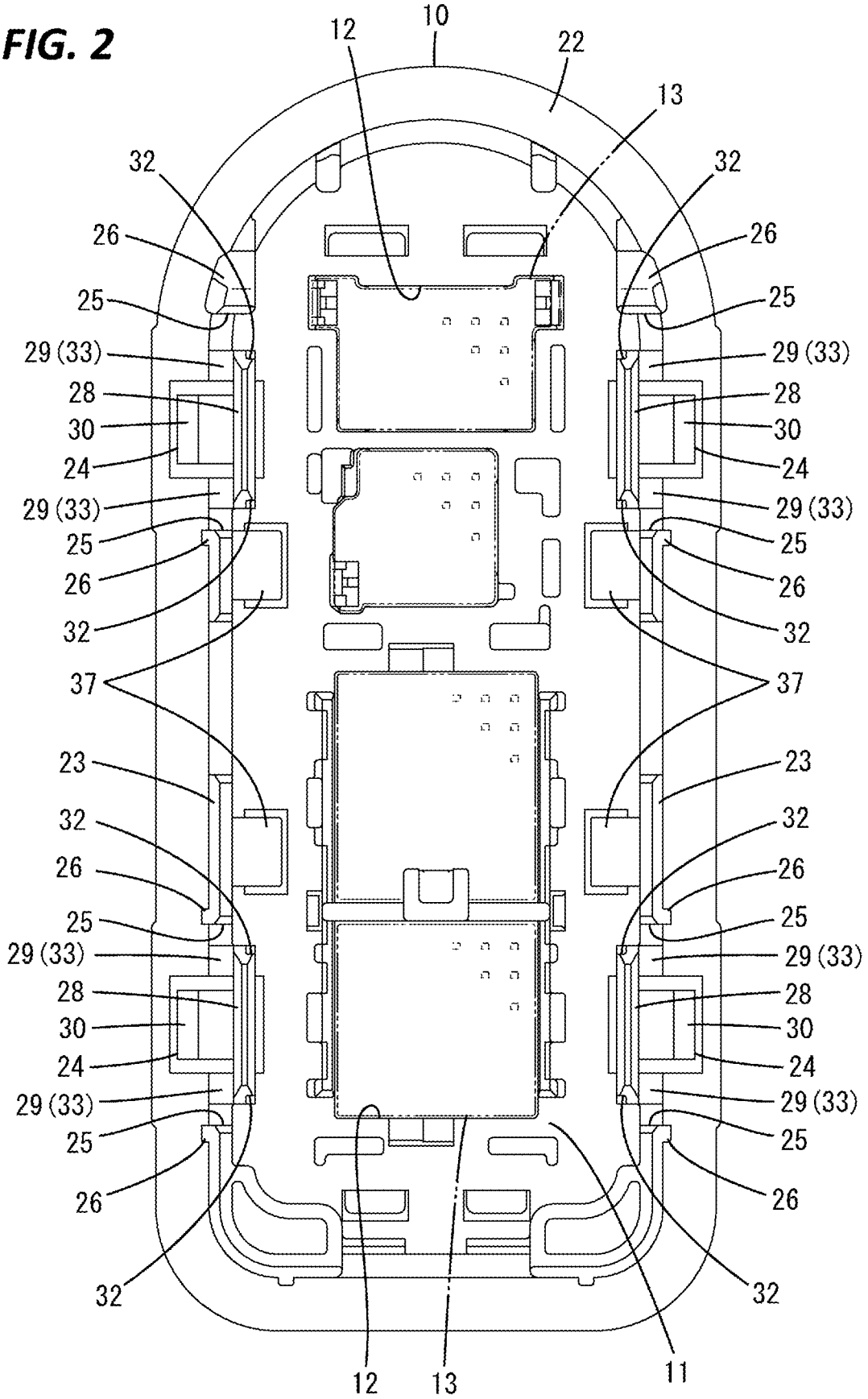
FIG. 2 is a front view of a first housing.
Figure 3:
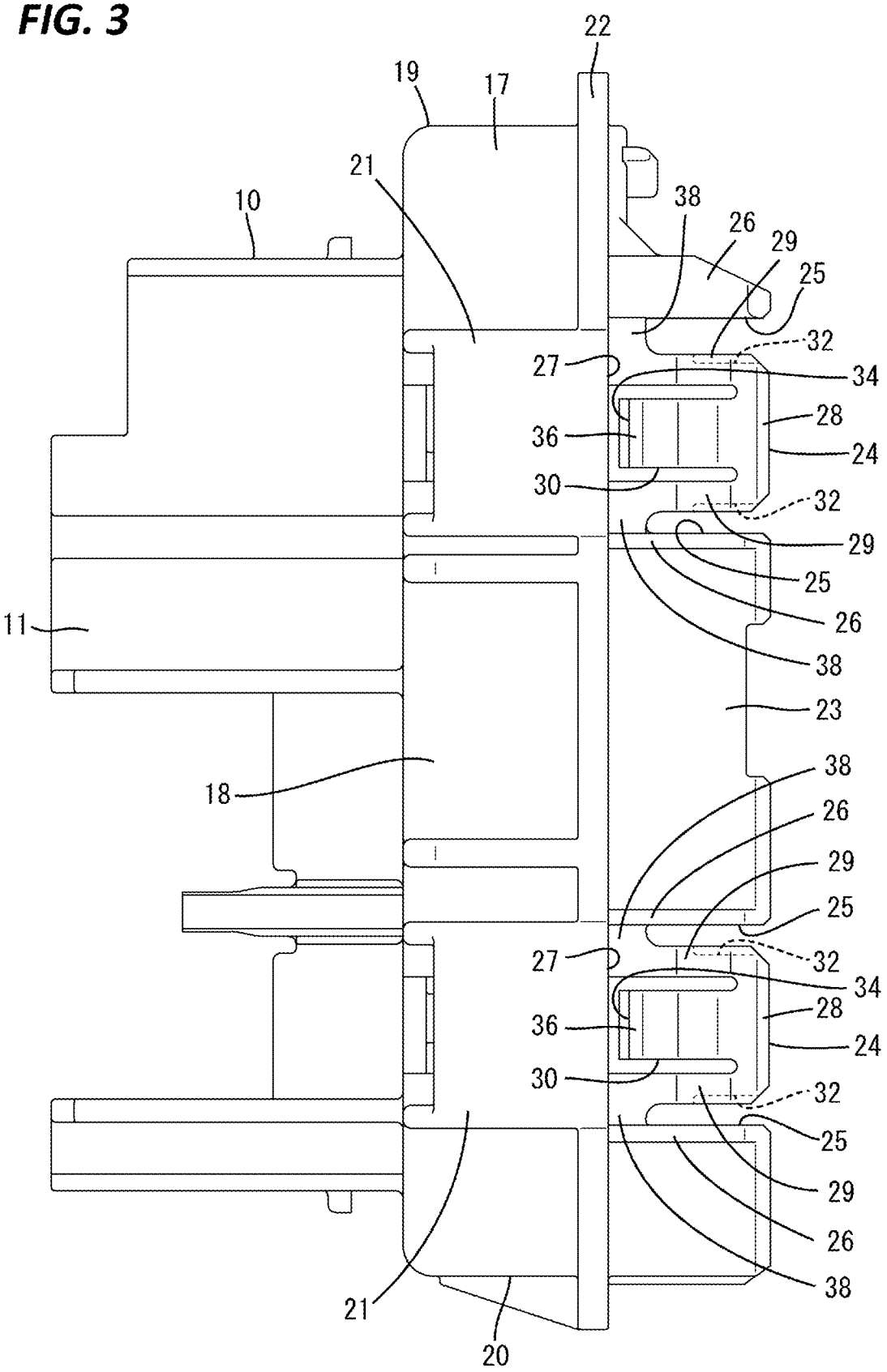
FIG. 3 is a side view of the first housing.

The first housing 10 is made of synthetic resin and, as shown in FIGS. 1 and 2, shaped to be long in the vertical direction as a whole to correspond to an opening shape of the mounting hole 91 of the panel 90. As shown in FIGS. 1 and 3, the first housing 10 includes a housing accommodating portion 11 in a rear part. As shown in FIG. 2, the housing accommodating portion 11 includes a plurality of accommodation chambers 12 arranged side by side in the vertical direction. Each accommodation chamber 12 is in the form of a rectangular opening penetrating in the front-rear direction. A male sub-housing 13 is accommodated and held in each accommodation chamber 12. A plurality of male terminals 14 are mounted into each male sub-housing 13. As shown in FIG. 1, the male terminal 14 is connected to an end part of a wire 15 and a tab 16 projects forward.

As shown in FIG. 1, the first housing 10 includes a receptacle 17 in a front part. The receptacle 17 has a tubular shape projecting forward from the housing accommodating portion 11. Although not shown, the tabs 16 of the respective male terminals 14 are arranged to project into the receptacle 17. The receptacle 17 includes a pair of left and right side plate portions 18, an upper plate portion 19 and a bottom plate portion 20 on a rear side. The both side plate portions 18 are arranged along the vertical direction. The upper plate portion 19 is shaped to be curved upward. The bottom plate portion 20 is arranged along a lateral direction. The both side plate portions 18 constitute long side parts facing each other in the lateral direction. The upper plate portion 19 and the bottom plate portion 20 constitute a pair of upper and lower short side parts.

As shown in FIGS. 1 and 3, the both side plate portions 18 include gate-shaped bulging portions 21 bulging outward (laterally) at vertically spaced apart positions. The inside of the bulging portion 21 penetrates in the front-rear direction. The receptacle 17 includes a flange portion 22 protruding outward. The front ends of the bulging portions 21 are integrally connected to the flange portion 22.

Figure 10:
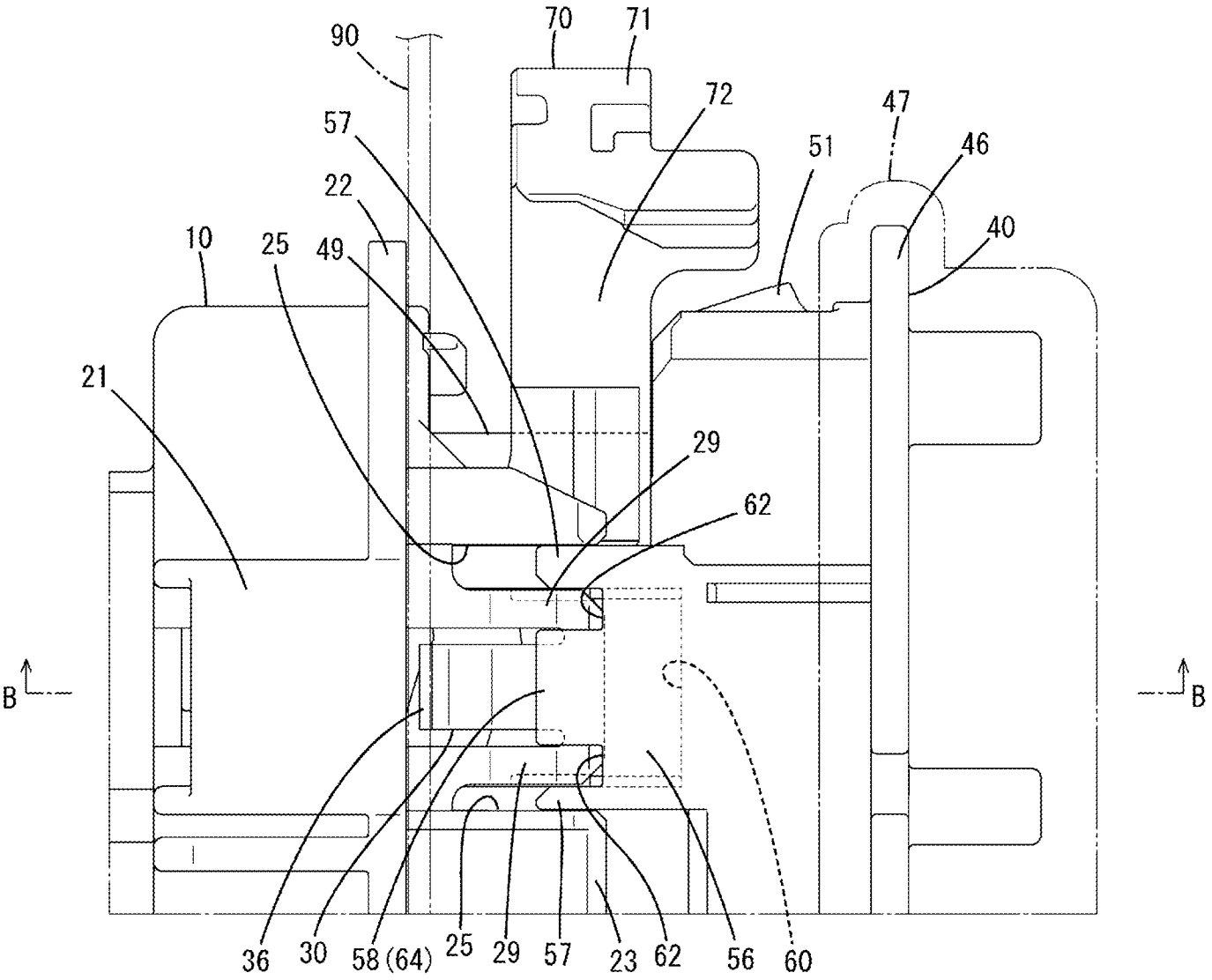
FIG. 10 is a partial enlarged side view showing a state where the both housings are lightly fit at the start of connection.

The front surface of the flange portion 22 is arranged along the vertical direction. As shown in FIG. 10, the front surface of the flange portion 22 can contact the rear surface of the panel 90. Note that the flange portion 22 constitutes base portions 27 to be described later.

As shown in FIGS. 1 to 4, the receptacle 17 includes side pieces 23 projecting forward from the flange portion 22. The side pieces 23 are arranged along the vertical direction. The side pieces 23 include lock portions 24 at vertically spaced apart positions. The lock portions 24 are arranged side by side with the bulging portions 21 in the front-rear direction via the flange portion 22.

Figure 4:
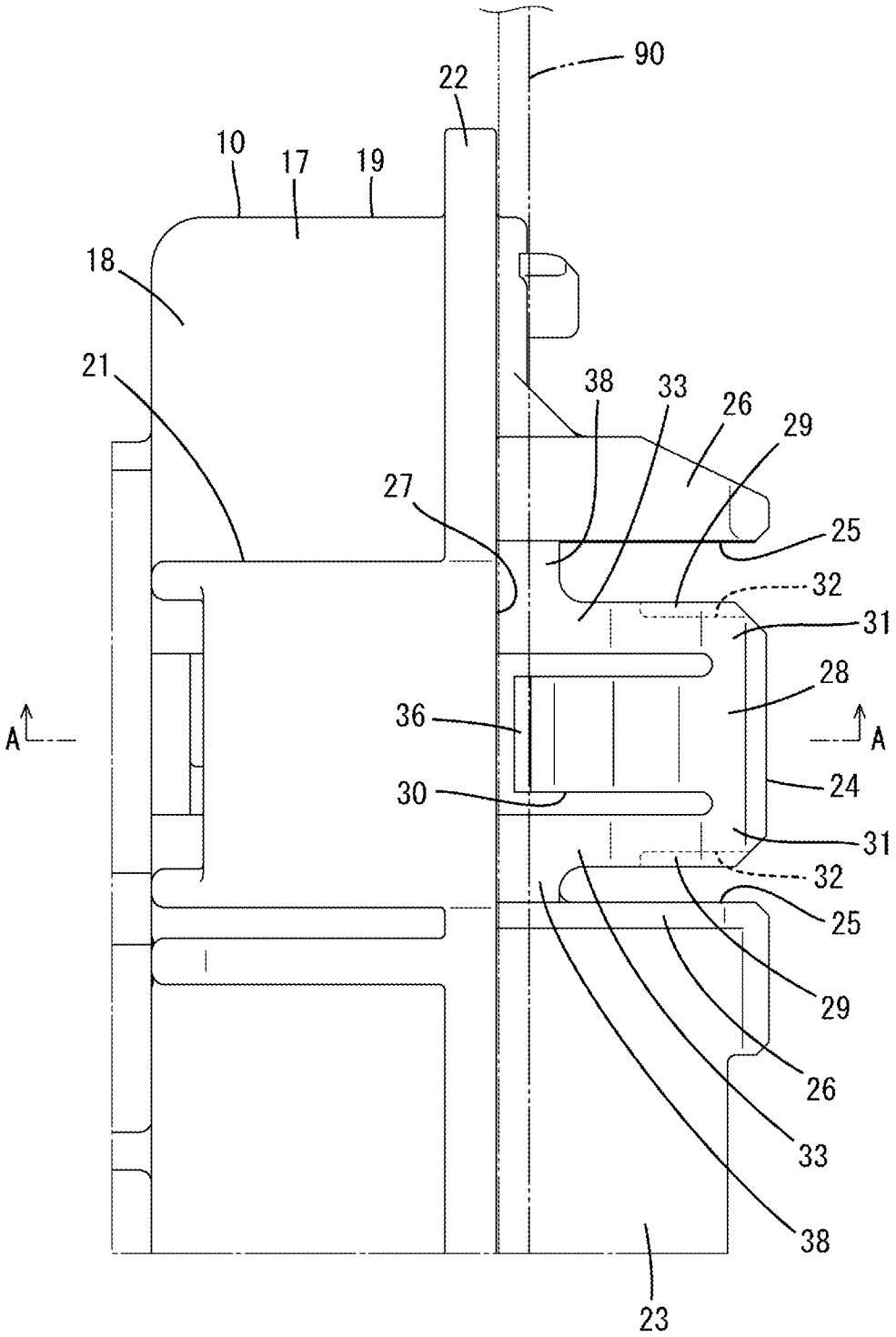
FIG. 4 is a partial enlarged side view of the first housing.

As shown in FIGS. 2 to 4, the lock portion 24 is provided between slits 25 vertically facing each other in the side piece 23. The slits 25 extend in the front-rear direction and are open in the front end of the side piece 23.

The side piece 23 includes protecting portions 26 arranged on both upper and lower sides of the lock portions 24 via the slits 25. The protecting portions 26 are in the form of thick ribs extending in the front-rear direction on the outer surface of the side piece 23. The lock portion 24 is protected by the protecting portions 26 on both upper and lower sides and interference with an external matter is avoided.

As shown in FIGS. 3 and 4, the lock portion 24 includes a coupling portion 28 located forward of the base portion 27 integrally configured to the flange portion 22, a pair of linking portions 29 linking the base portion 27 and the coupling portion 28 and a lock arm 30 projecting rearward toward the base portion 27 from the coupling portion 28.

Figure 5:
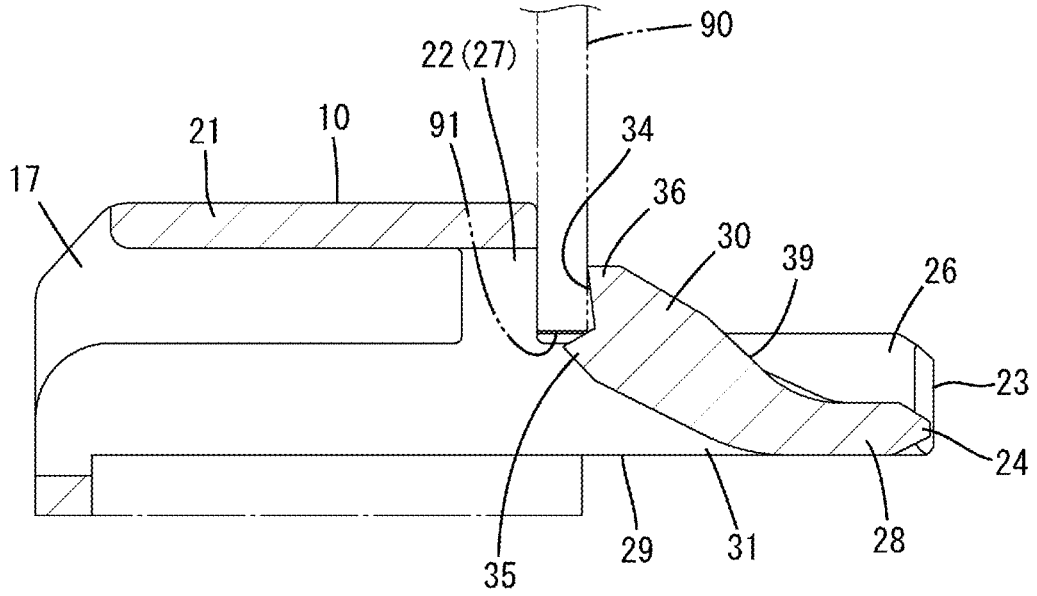
FIG. 5 is a section along A-A of FIG. 4.
Figure 14:
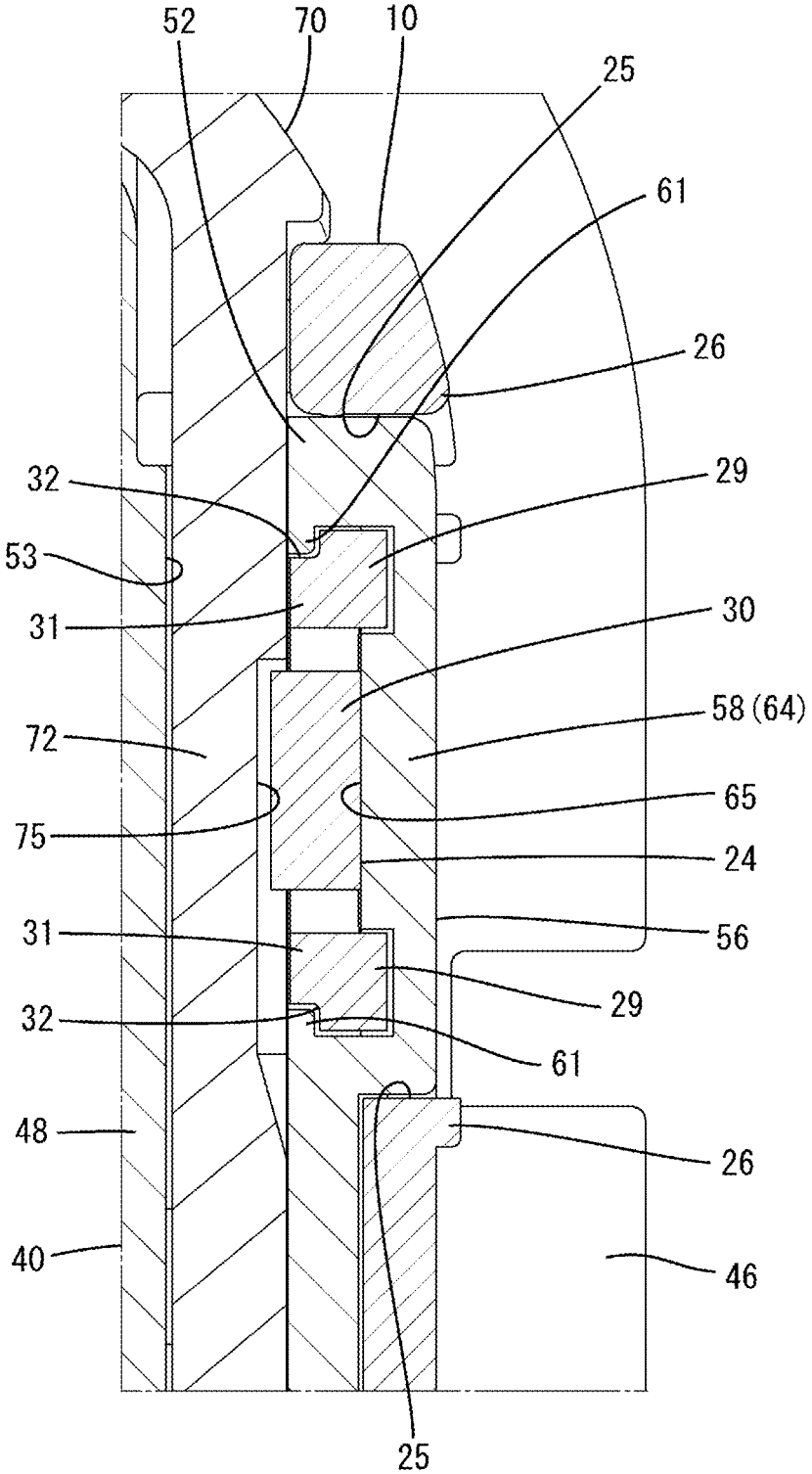
FIG. 14 is a section along D-D of FIG. 12.

As shown in FIGS. 1 and 5, the linking portions 29 include a pair of rib-shaped linking body portions 31 projecting forward beyond the flange portion 22 from the inner surface of the side plate portion 18 (surface facing the inside of the receptacle 17). As shown in FIGS. 4 and 14, the inner surface of a front end part of the linking body portion 31 is cut to provide a recess 32. The recess 32 extends in the front-rear direction and is open in the front surface of the linking body portion 31 and a side surface of the linking body portion 31 facing the slit 25. A later-described restricting portion 61 of the second housing 40 enters the recess 32. The restricting portion 61 is arranged to contact a concave surface of the recess 32 extending along the front-rear direction.

As shown in FIG. 4, the linking portion 29 includes a thick portion 33 thickened on an outer side of the linking body portion 31 from the base portion 27 toward the coupling portion 28. The outer surface of a rear part of the thick portion 33 is continuous and flush with an outer surface portion 38 of the side piece 23 arranged between the flange portion 22 and the protecting portion 26. The front surface of the thick portion 33 has a slope shape inclined inwardly toward the coupling portion 28.

The coupling portion 28 is shaped to vertically extend between front end parts of the upper and lower linking portions 29 (linking body portions 31). The coupling portion 28 is located inwardly of the thick portions 33. As shown in FIG. 5, the inner surface of the coupling portion 28 is continuous with the inner surfaces of the linking body portions 31 without any step in the front-rear direction.

The lock arm 30 is arranged between the pair of linking portions 29. As shown in FIG. 5, the lock arm 30 is in the form of a claw whose thickness is gradually increased toward a rear side from the coupling portion 28. As shown in FIGS. 3 and 4, clearances extending along the front-rear direction are formed between the lock arm 30 and the linking portions 29. Further, a clearance extending in the vertical direction is formed between the lock arm 30 and the base portion 27. As shown in FIG. 5, the rear surface of the lock arm 30 is arranged to face the inside of the bulging portion 21. The lock arm 30 has an overhanging lock surface 34 inclined rearwardly with respect to the vertical direction on the rear surface. The lock surface 34 of the lock arm 30 is arranged to contact and be lockable to the front surface of the panel 90.

As shown in FIG. 5, the lock arm 30 includes an inclination restricting portion 35 projecting rearward from an inner side of the lock surface 34. The outer surface of the inclination restricting portion 35 is connected at an obtuse angle to the lock surface 34 and arranged to contact a hole surface of the mounting hole 91 of the panel 90. A top part 36 (outermost end part) of the lock arm 30 is arranged to project further outward than the protecting portions 26. The front surface of the lock arm 30 is formed into a slope 39 inclined rearwardly as a whole.

The lock arm 30 can be deflected and deformed (resiliently deformed) inwardly and outwardly with the coupling portion 28 as a fulcrum. Further, the linking portions 29 can be deflected and deformed inwardly and outwardly with the base portion 27 as a fulcrum. The lock arm 30 and the linking portions 29 are both deflected and deformed inwardly with the top part 35 held in contact with the panel 90 in the process of mounting the first housing 10 on the panel 90.

As shown in FIGS. 1 and 2, the receptacle 17 includes a plurality of cylindrical cam followers 37 projecting on left and right inner surfaces. The respective cam followers 37 are paired and arranged at positions overlapping the flange portion 22 in the front-rear direction and spaced apart in the vertical direction.

(Second Housing 40)

Figure 6:
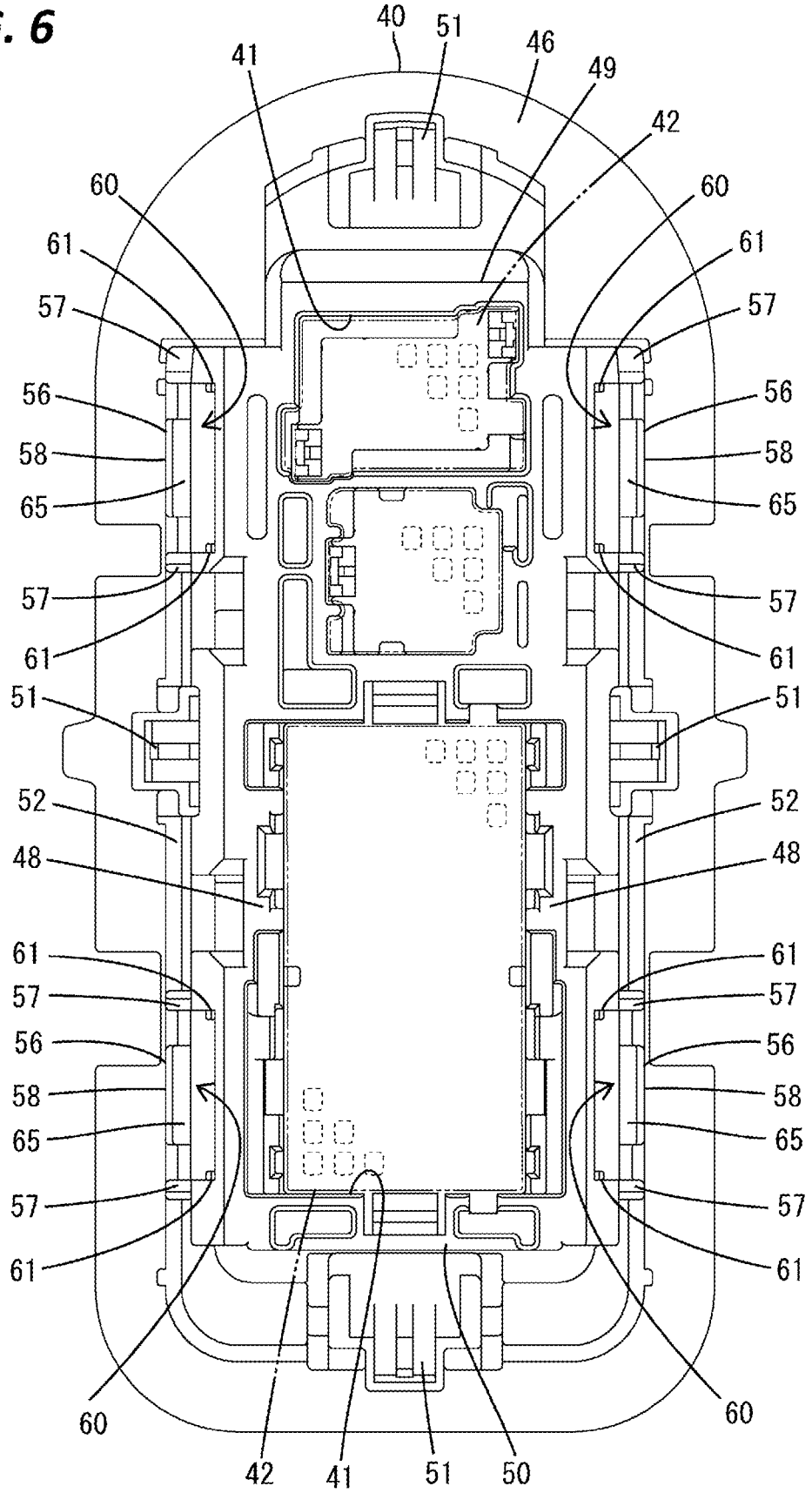
FIG. 6 is a front view of a second housing.
Figure 7:
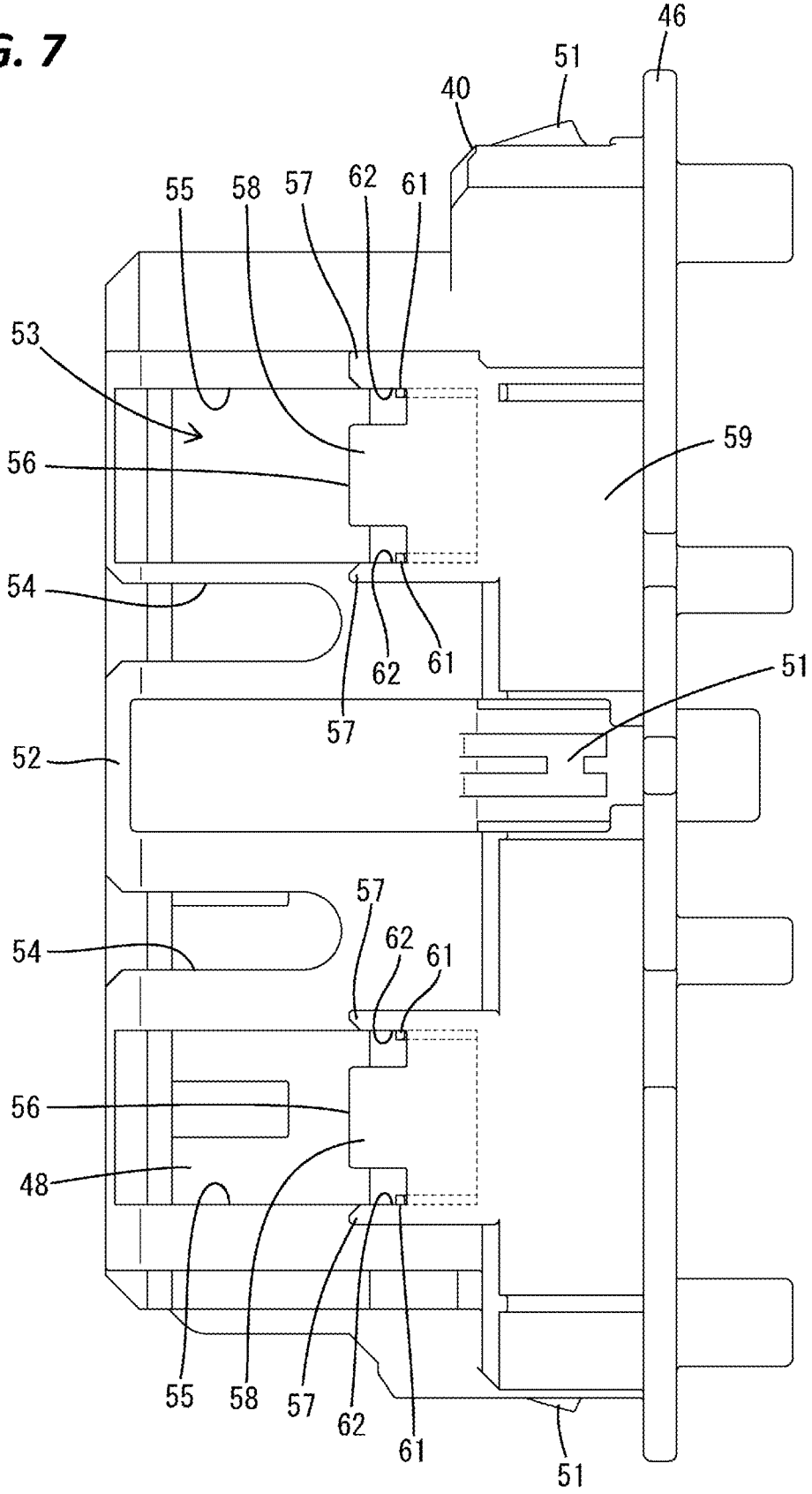
FIG. 7 is a side view of the second housing.

The second housing 40 is made of synthetic resin and, as shown in FIGS. 1, 6 and 7, shaped to be long in the vertical direction as a whole. As shown in FIG. 6, the second housing 40 includes a plurality of sub-housing accommodation chambers 41 arranged side by side in the vertical direction inside. Each sub-housing accommodation chamber 41 is in the form of a rectangular opening penetrating in the front-rear direction. A female sub-housing 42 is accommodated and held in each sub-housing accommodation chamber 41. A plurality of female terminals 43 are mounted into each female sub-housing 42. As shown in FIG. 1, the female terminal 43 is connected to an end part of a wire 44 and includes a tubular connecting portion 45 in a front part. When the both housings 10, 40 are connected, the tab 16 of the male terminal 14 is inserted into the connecting portion 45 of the female terminal 43 and the both male and female terminals 14, 43 are electrically connected.

Figure 11:
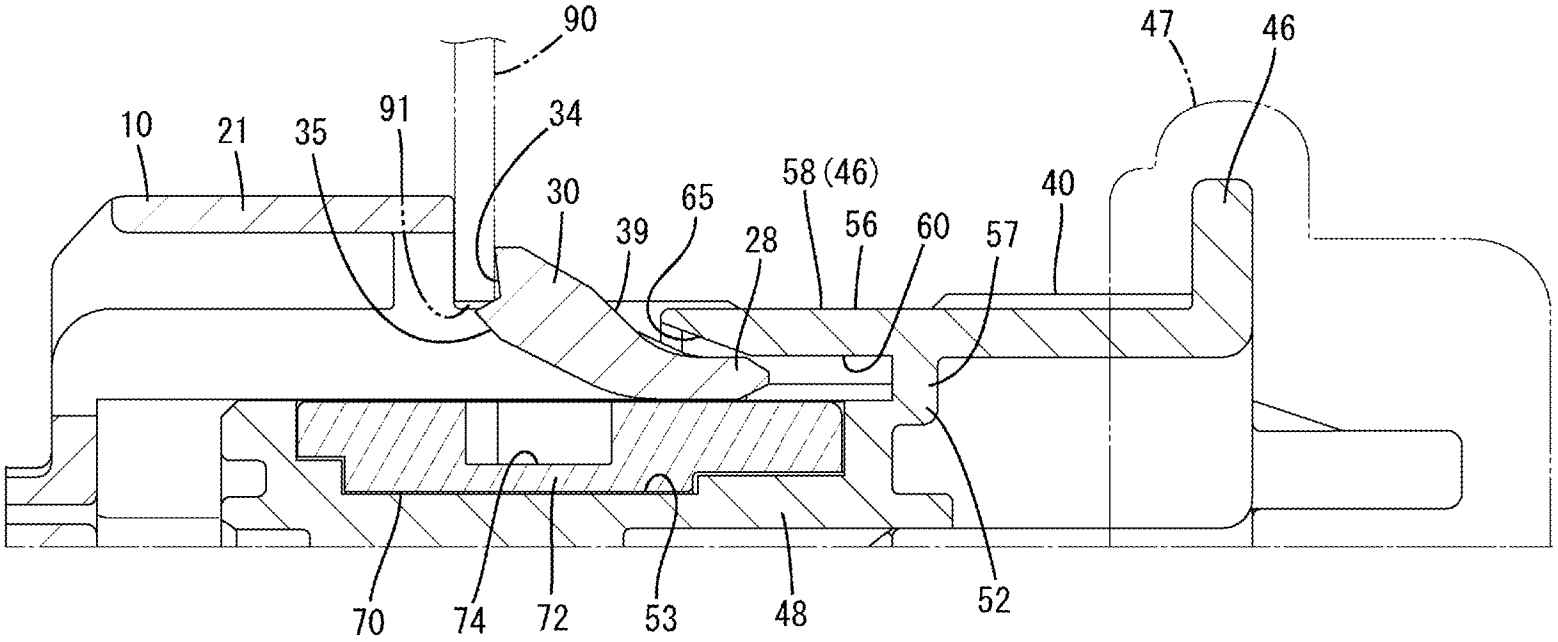
FIG. 11 is a section along B-B of FIG. 10.
Figure 12:
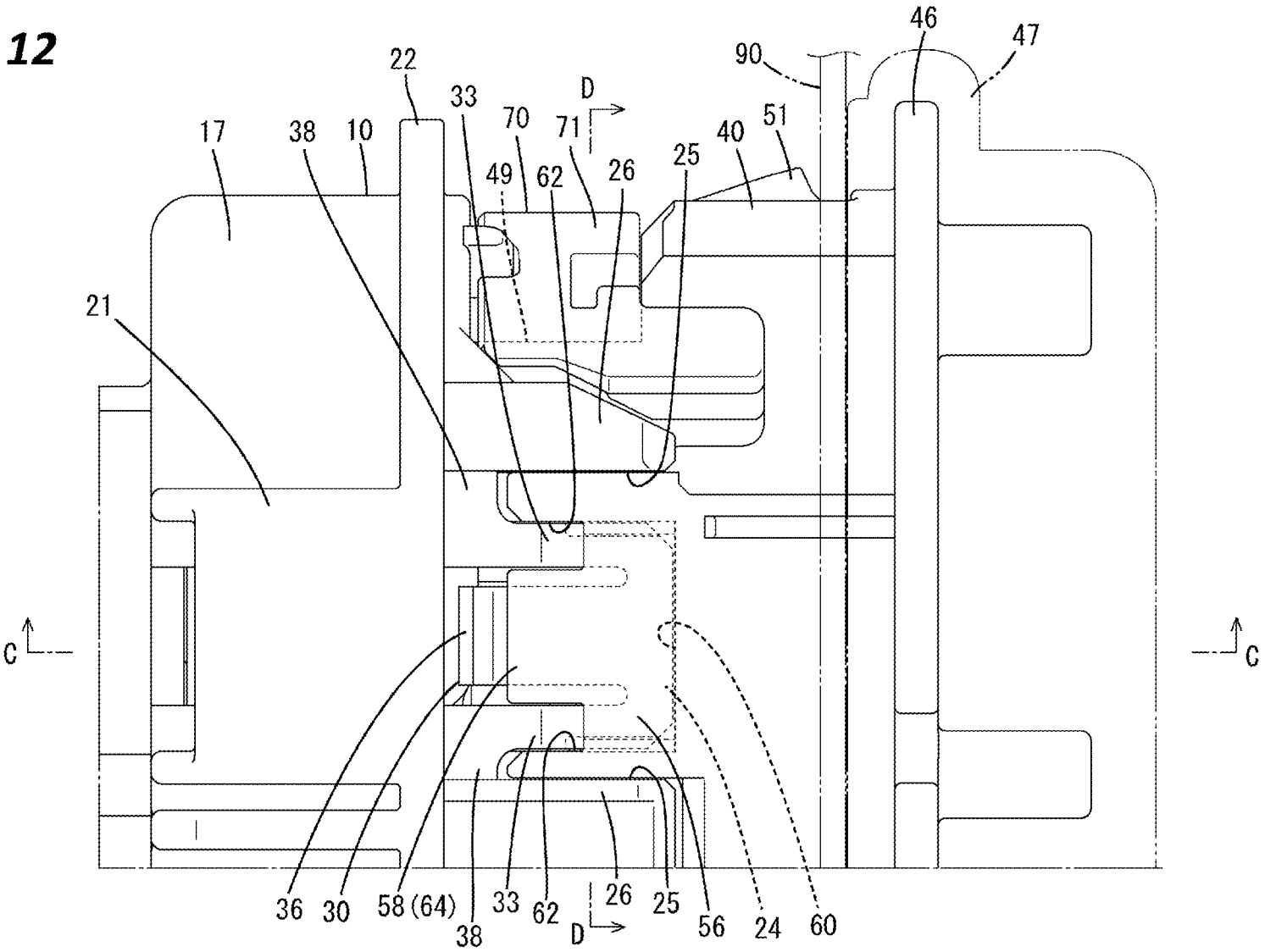
FIG. 12 is a partial enlarged side view showing a state where the both housings are connected to a proper depth.
Figure 13:
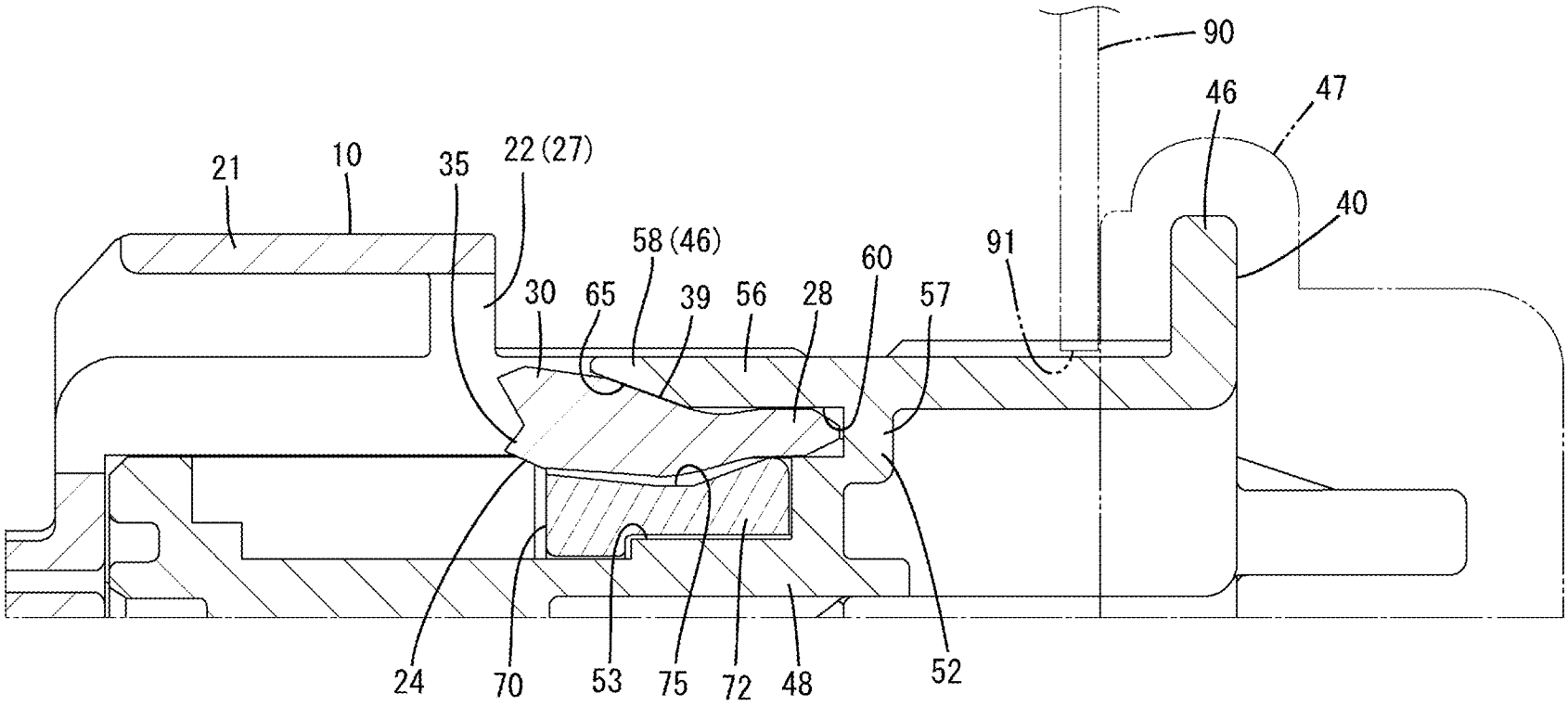
FIG. 13 is a section along C-C of FIG. 12.

The second housing 40 includes a flange portion 46 protruding outward in a rear end part. As shown in FIGS. 11 to 13, the flange portion 46 is covered with a grommet 47. As shown in FIG. 13, the grommet 47 is arranged in close contact with the front surface of the panel 90 while being mounted on the flange portion 46.

As shown in FIG. 6, the second housing 40 includes a pair of left and right side walls 48, an upper wall 49 and a bottom wall 50 on a side forward of the flange portion 46. The both side walls 48 are arranged along the vertical direction. The upper wall 49 and the bottom wall 50 are arranged along the lateral direction.

The second housing 40 includes panel lock portions 51 respectively behind the both side walls 48, the upper wall 49 and the bottom wall 50. Each panel lock portion 51 is in the form of a resiliently deformable arm. Each panel lock portion 51 is arranged to contact and be lockable to the rear surface of the panel 90 after the connection of the both housings 10, 40 (see FIG. 12).

The second housing 40 includes outer walls 52 (see FIGS. 1, 7 and 14) outward of the both side walls 48 across gaps (space portions 53 to be described later). Both left and right side parts of the second housing 40 include the space portions 53 penetrating in the vertical direction between the side walls 48 and the outer walls 52. The space portion 53 is in the form of an opening elongated in the front-rear direction. As shown in FIG. 14, later-described arm plates 72 of the lever 70 are inserted into the space portions 53 from above.

As shown in FIG. 7, the outer wall 52 includes a pair of entrance grooves 54 at positions spaced apart in the vertical direction. The respective entrance grooves 54 communicate with the space portion 53, extend in the front-rear direction and are open in the front end of the outer wall 52. The cam followers 37 enter the respective entrance grooves 54 from front.

Further, the outer wall 52 includes a pair of introduction grooves 55 on both upper and lower sides across the both entrance grooves 54. The respective introduction grooves 55 communicate with the space portion 53, extend in the front-rear direction and are open in the front end of the outer wall 52. A vertical opening width of the respective introduction grooves 55 is larger than that of the entrance grooves 54. The lock portions 24 are introduced into the respective introduction grooves 55 from front.

Figure 8:
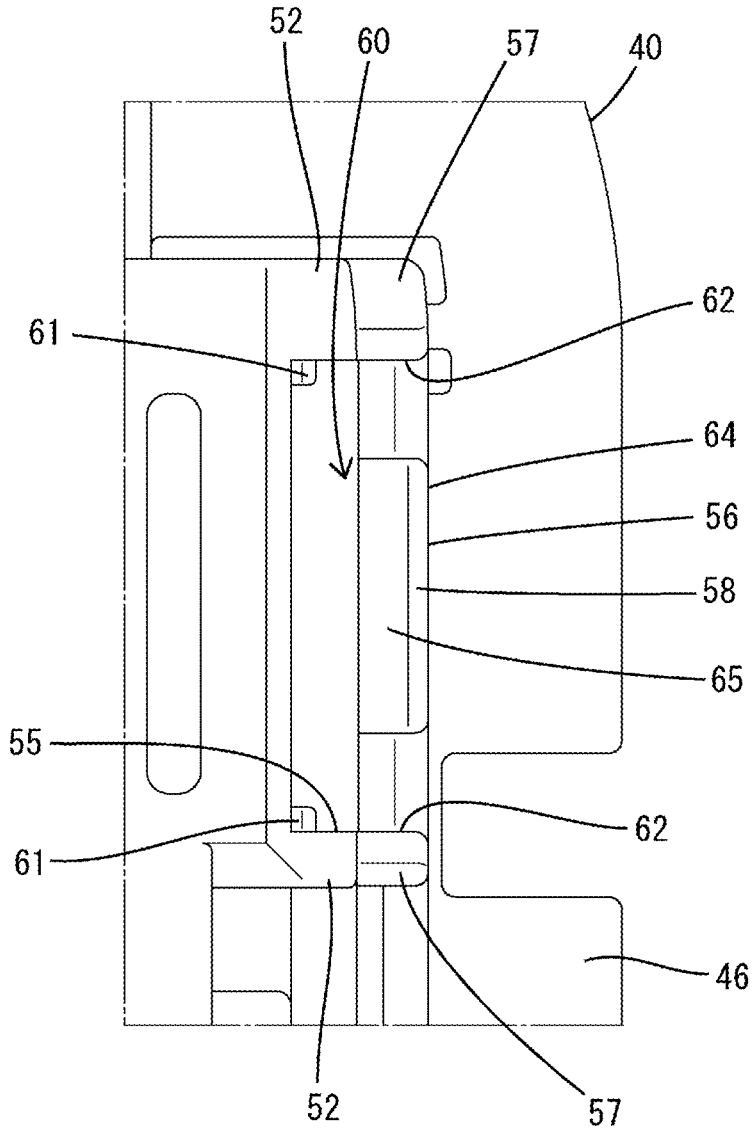
FIG. 8 is a partial enlarged front view of the second housing.
Figure 9:
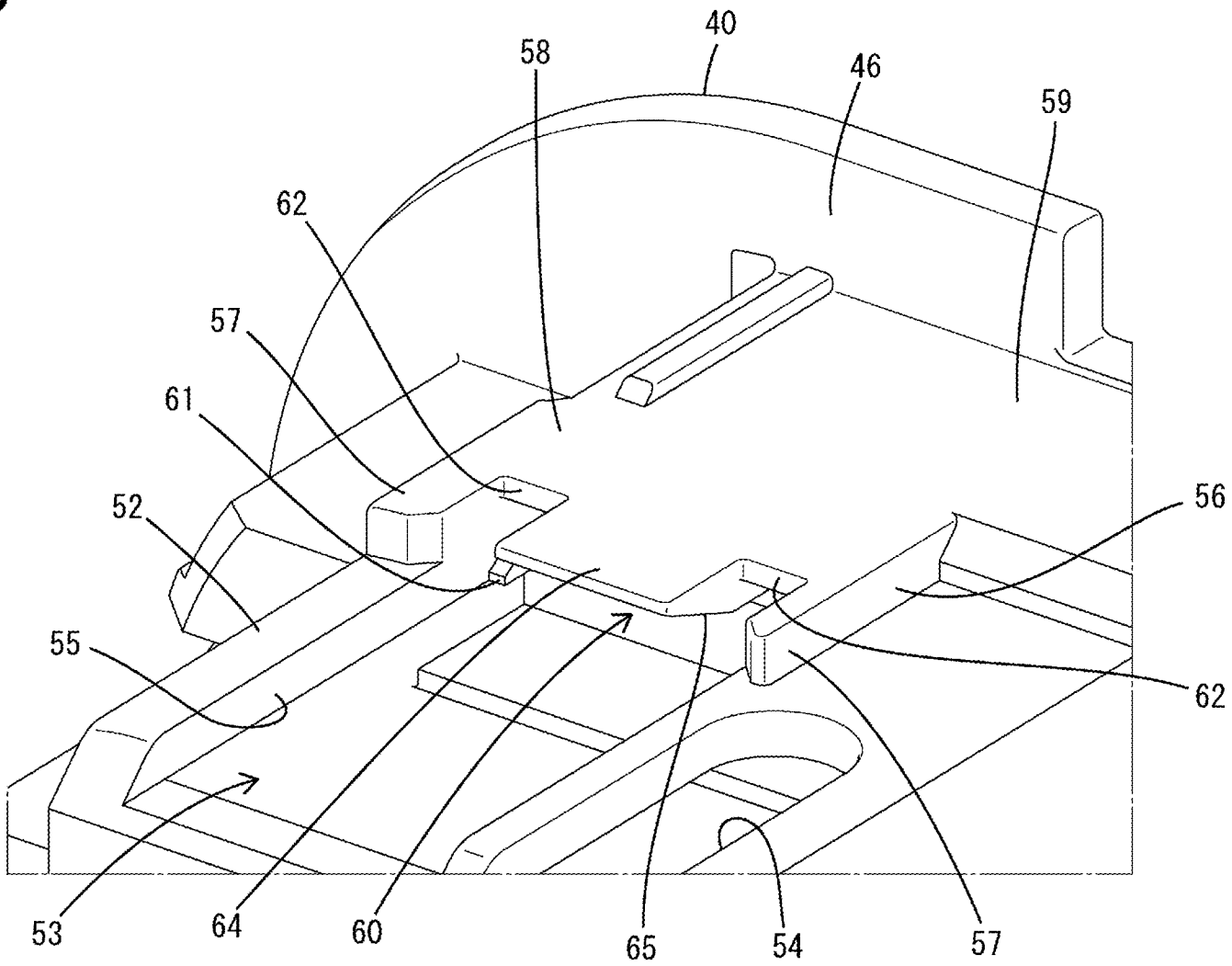
FIG. 9 is a partial enlarged perspective view of the second housing.

Further, the outer wall 52 includes arch portions 56 behind the respective introduction grooves 55. As shown in FIGS. 8 and 9, the arch portion 56 has an arch shape as a whole and includes a pair of leg portions 57 rising outward from the outer wall 52 while facing each other and a bridge portion 58 provided to extend between the rising ends of the both leg portions 57.

As shown in FIGS. 7 and 9, the both leg portions 57 are in the form of ribs along the front-rear direction continuous with upper and lower groove edges of the introduction groove 55. The bridge portion 58 is in the form of a plate flat along the lateral direction. The outer surfaces of the bridge portion 58 and the both leg portions 57 are continuous and flush with each other and continuous and flush with the outer surface of a rear outer wall 59 provided between the flange portion 46 and the arch portion 56.

As shown in FIG. 9, an arched inner space defined by the bridge portion 58 and the both leg portions 57 serves as an entrance space 60 communicating with the introduction groove 55. As shown in FIG. 12, the lock portion 24 enters the entrance space 60 of the arch portion 56.

As shown in FIG. 8, the outer wall 52 includes a pair of the restricting portions 61 protruding along the upper and lower groove edges of the introduction groove 55 at positions facing the entrance space 60. The both restricting portions 61 are arranged to vertically face each other and, as shown in FIG. 7, in the form of plate pieces long in the front-rear direction.

As shown in FIGS. 8 and 9, the bridge portion 58 includes a pair of cut portions 62 in both left and right end parts. As shown in FIG. 7, a front end part of the restricting portion 61 is arranged to be located in the cut portion 62. The cut portion 62 extends in the front-rear direction along the leg portion 57 and is open in the front end of the bridge portion 58. As shown in FIG. 12, the thick portion 33 of the lock portion 24 enters the cut portion 62.

As shown in FIGS. 8 and 9, the bridge portion 58 includes a projecting piece 64 between the both cut portions 62. A releasing portion 65 in the form of a slope expanded outwardly toward the front is provided on the inner surface of the projecting piece 64. The releasing portion 65 is facing the front end edge of the projecting piece 64 and provided over the entire width of the projecting piece 64. As shown in FIG. 13, the releasing portion 65 presses the slope 39 of the lock arm 30 to release a state where the lock surface 34 of the lock arm 30 is in contact with the panel 90.

(Lever 70)

The lever 70 is made of synthetic resin and includes, as shown in FIG. 1, a coupling plate portion 71 and a pair of the arm plates 72 projecting downward from both left and right end parts of the coupling plate portion 71. The both arm plates 72 are in the form of plates extending along the vertical direction and inserted into the corresponding space portions 53 of the second housing 40 from above. The coupling plate portion 71 is shaped to be curved upwardly.

The lever 70 can slide from a partial locking position to a full locking position with respect to the second housing 40. The coupling plate portion 71 is arranged above and away from the upper wall 49 at the partial locking position (see FIG. 10), and is arranged in contact with the upper surface of the upper wall 49 to be stopped at the full locking position (see FIG. 12).

As shown in FIG. 1, the both arm plates 72 include locking portions 73 in the form of projections on rear ends. The locking portions 73 are locked by corresponding locking structures of the second housing 40, whereby the lever 70 is held at each of the partial locking position and the full locking position. Each of the both arm plates 72 includes two cam grooves 74 arranged side by side in the vertical direction. The entrances of the respective cam grooves 74 are open in the front ends of the both arm plates 72. The corresponding cam followers 37 of the first housing 10 enter the respective cam grooves 74.

The both arm plates 72 have facing surfaces 75 on upper end parts near the coupling plate portion 71 as shown in FIGS. 13 and 14. The facing surfaces 75 face the lock arms 30 of the lock portions 24 and the like when the both housings 10, 40 are connected. As shown in FIG. 1, the facing surface 75 is configured as a concave surface recessed from the surrounding on the outer surface of the arm plate 72. The facing surface 75 is facing the front end edge of the arm plate 72 and is curved into a concave surface. As shown in FIG. 13, the deflected and deformed lock arm 30 and the like enter inside the facing surface 75 of the arm plate 72.

<Assembling and Connecting Structure of Connector>

In assembling, the first housing 10 is inserted into the mounting hole 91 of the panel 90 from behind. In the process of inserting the first housing 10 into the mounting hole 91 of the panel 90, the lock arms 30 contact the opening edge part of the mounting hole 91 in the rear surface of the panel 90 and are deflected and deformed inwardly with the coupling portions 28 as fulcrums. As the lock arms 30 are deflected and deformed, the coupling portions 28 are also displaced inwardly. When the coupling portions 28 are further displaced inwardly, the linking portions 29 are also deflected and deformed inwardly with the base portions 27 as fulcrums. In this way, both the lock arms 30 and the linking portions 29 are deflected and deformed, whereby resilient displacement amounts of the lock arms 30 are suppressed to be small as compared to the case where only the lock arms 30 are deflected and deformed.

When the top parts 36 of the lock arms 30 reach the front surface side of the panel 90, the lock arms 30 resiliently return together with the linking portions 29. In this way, as shown in FIG. 5, the lock surfaces 34 of the lock arms 30 are arranged to contact and be lockable to the front surface of the panel 90. Further, the front surface of the flange portion 22 is arranged to face the rear surface of the panel 90. The first housing 10 is mounted on the panel 90 with the panel 90 sandwiched between the lock arms 30 and the flange portion 22.

If a force is applied to pull out the first housing 10 toward the rear surface side of the panel 90, for example, by pulling the wires 15 with the first housing 10 mounted on the panel 90, the lock arms 30 may be excessively inclined outwardly together with the linking portions 29. However, in the case of this embodiment, the inclination restricting portions 35 contact the hole surface of the mounting hole 91 of the panel 90, whereby the lock arms 30 can be prevented from being deflected and deformed to be excessively inclined outwardly.

Subsequently, the second housing 40 is lightly fit (inserted) into the receptacle 17 of the first housing 10. At this time, the lever 70 is held at an initial position with respect to the second housing 40. At the initial position, the entrances of the respective cam grooves 74 are open forward to face the respective entrance grooves 54.

When the second housing 40 is lightly fit into the receptacle 17, the respective cam followers 37 enter the entrances of the respective cam grooves 74 via the respective entrance grooves 54. If the coupling plate portion 71 is pressed downward in that state, the lever 70 moves toward the full locking position. In the process of moving the lever 70, the respective cam followers 37 slide on groove surfaces of the respective cam grooves 74 to exhibit a cam action between the lever 70 and the first housing 10. In this way, the second housing 40 is deeply fit into the receptacle 17 of the first housing 10.

In the process of connecting the second housing 40 to the first housing 10, the both leg portions 57 of the arch portions 56 are fit to enter the corresponding slits 25 and the lock portions 24 enter the entrance spaces 60 of the arch portions 56 from the introduction grooves 55 as shown in FIG. 10. Then, the projecting pieces 64 of the bridge portions 58 ride on the slopes 39 of the lock arms 30, the releasing portions 65 press the lock arms 30 inwardly and the lock arms 30 are deflected and deformed inwardly together with the linking portions 29. Here, as shown in FIG. 14, the restricting portions 61 enter the recesses 32 of the deflected and deformed linking portions 29 and contact the concave surfaces of the recesses 32, whereby any further resilient deformation of the linking portions 29 is restricted. Further, the deflected and deformed lock arms 30 and linking portions 29 enter the space portions 53 of the second housing 40 as shown in FIG. 14, but can avoid interference with the arm plates 72 by being spaced apart from the facing surfaces 75 of the lever 70 across clearances. Thus, the lever 70 can smoothly move toward the full locking position.

When the second housing 40 is fit to a proper depth into the receptacle 17 of the first housing 10, the lock surfaces 34 of the lock arms 30 are separated from the front surface of the panel 90 to release the state where the lock arms 30 are locked to the front surface of the panel 90.

With the both housings 10, 40 properly connected, the releasing portions 65 are maintained in a state in contact with the slopes 39 of the lock arms 30 (see FIG. 13) and the restricting portions 61 are maintained in a state arranged along the concave surfaces of the recesses 32 (see FIG. 14). Further, as shown in FIG. 12, the thick portions 33 of the linking portions 29 are fit to enter the cut portions 62.

Subsequently, the second housing 40 is pushed toward the rear surface side of the panel 90 together with the first housing 10. In this way, the lock portions 24 of the first housing 10 and the lever 70 pass through the mounting hole 91 and reach the rear surface side of the panel 90. Thereafter, as shown in FIG. 12, the respective panel lock portions 51 of the second housing 40 are resiliently locked to the rear surface of the panel 90. In this way, the second housing 40 is retained and mounted on the panel 90. In this state, the grommet 47 mounted on the flange portion 46 of the second housing 40 is held in close contact with the front surface of the panel 90. As a result, the second housing 40 is mounted on the panel 90 in a liquid-tight manner.

As described above, according to this embodiment, the releasing portions 65 of the second housing 40 press the lock arms 30 of the first housing 10 and the first housing 10 is released from a state locked to (mounted on) the front surface of the panel 90 in the process of connecting the both housings 10, 40. In this case, the releasing portions 65 are provided on the bridge portions 58, which are parts of the arch portions 56. The arch portions 56 are provided on the outer walls 52 of the space portions 53. Since the arm plates 72 of the lever 70 are arranged to enter the space portions 53, the outer walls 52 tend to be thin. However, the outer walls 52 are reinforced by the arch portions 56 and the rigidity of the releasing portions 65 is enhanced. As a result, the releasing portions 65 can maintain durability against reaction forces of the lock arms 30. Further, the releasing portions 65 are provided on the outer walls 52 of the space portions 53 and the space portions 53 and the first housing 10 are arranged to overlap each other in the front-rear direction when the both housings 10, 40 are connected. This can contribute to the miniaturization of the connector.

Further, when the top parts 36 of the lock arms 30 contact the opening edge part of the mounting hole 91 in the rear surface of the panel 90 in the process of mounting the first housing 10 on the panel 90, the lock arms 30 can be deflected and deformed and the linking portions 29 can also be deflected and deformed. The linking portions 29 are deflected and deformed in addition to the lock arms 30, whereby the lock portions 24 can be largely deflected and deformed as a whole. As a result, resistance generated when the lock arms 30 contact the panel 90 can be reduced and the first housing 10 can be easily mounted on the panel 90. This embodiment can be effectively applied particularly if burrs are formed on the opening edge part of the mounting hole 91 in the rear surface of the panel 90.

Further, the respective leg portions 57 of the second housing 40 are fit to enter the corresponding slits 25, whereby vertical movements of the linking portions 29 can be restricted. As a result, the lock arms 30 can be stably deflected.

Further, since the facing surfaces 75 of the lever 70 are formed into the concave surfaces to escape from the deflected and deformed lock arms 30, the contact of the lever 70 with the lock arms 70 can be avoided and the lever 70 can be smoothly moved. Furthermore, since the linking portions 29 are provided with the recesses 32 into which the restricting portions 61 enter, large resilient deformation amounts of the linking portions 29 enlarged by the recesses 32 can be secured.

Furthermore, the inclination restricting portions 35 contact the hole surface of the mounting hole 91 of the panel 90, whereby the lock arms 30 can be prevented from being excessively inclined in inverting directions and holding forces of the lock arms 30 onto the panel 90 can be improved.

Other Embodiments of Present Disclosure

The embodiment disclosed this time should be considered to be illustrative rather than restrictive in all aspects.

Although the restricting portion enters the recess of the linking portion to restrict the resilient deformation of the linking portion in the case of the above embodiment, no recess may be provided in a linking portion and a restricting portion may contact a general surface (surface to which no special processing is applied) of the linking portion to restrict the resilient deformation of the linking portion as another embodiment.

Although the pair of linking portions are configured to respectively contact the corresponding restricting portions in the case of the above embodiment, one of a pair of linking portions may be configured to contact a corresponding restricting portion as another embodiment.

Although the base portions are provided on the flange portion in the case of the above embodiment, base portions may be provided on a part of a first housing other than a flange portion as another embodiment.

Although the lever is arranged slidably with respect to the second housing in the case of the above embodiment, a lever may be arranged rotatably with respect to a second housing as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a first housing;

a second housing connectable to the first housing; and a lever arranged on the second housing, the lever being capable of promoting connection of the first housing and the second housing, wherein the first housing includes:

a resiliently deformable lock arm, and the lock arm of the first housing has a lock surface to be arranged to contact a front surface of a panel at a rear end portion of the lock arm in a direction in which the first housing is connected to the second hosing with the first housing arranged in a mounting hole of the panel, the second housing includes:

a space portion into which an arm plate of the lever is arranged;

leg portions rising from a side of an outer wall of the space portion while facing each other; and a bridge portion extending between the leg portions facing each other, and the bridge portion includes a releasing portion capable of releasing a state where the lock surface of the lock arm is in contact with the front surface of the panel.

2. The connector of claim 1, wherein:

the first housing includes:

a base portion;

a coupling portion located forward of the base portion; and a linking portion linking between the base portion and the coupling portion, and the lock arm is shaped to project rearward toward the base portion from the coupling portion.

3. The connector of claim 2, wherein:

the first housing includes protecting portions on both sides of the linking portion via slits, and the leg portions are arranged in the slits with the first and second housings connected.

4. The connector of claim 1, wherein the lock arm of the first hosing includes a protruding portion protruding from the lock surface of the lock arm in an opposite direction to the direction in which the first housing is connected to the second housing.

5. The connector of claim 4, wherein an outer surface of the protruding portion of the lock arm is connected to the lock surface of the lock arm at an obtuse angle and arranged to contact an inner peripheral surface of the mounting hole of the panel.

6. The connector of claim 1, wherein the lock arm of the first hosing includes a slope inclined downwardly in the direction in which the first housing is connected to the second housing.

7. The connector of claim 6, wherein the releasing portion of the bridge portion presses the slope of the lock arm to release the state where the lock surface of the lock arm is in contact with the front surface of the panel.

* * * * *